US011363835B2

(12) United States Patent
Monzoni et al.

(10) Patent No.: US 11,363,835 B2
(45) Date of Patent: Jun. 21, 2022

(54) MACHINE FOR THE PRODUCTION OF A COMPONENT FOR AN AEROSOL GENERATING ARTICLE

(71) Applicant: PHILIP MORRIS PRODUCTS S.A., Neuchatel (CH)

(72) Inventors: Alberto Monzoni, Bologna (IT); Stefano Malossi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 288 days.

(21) Appl. No.: 16/613,156

(22) PCT Filed: May 18, 2018

(86) PCT No.: PCT/EP2018/063213

§ 371 (c)(1),
(2) Date: Nov. 13, 2019

(87) PCT Pub. No.: WO2018/211116

PCT Pub. Date: Nov. 22, 2018

(65) Prior Publication Data

US 2020/0178595 A1 Jun. 11, 2020

(30) Foreign Application Priority Data

May 19, 2017 (EP) ..... 17171924

(51) Int. Cl.
*A24C 5/20* (2006.01)
*A24F 42/80* (2020.01)
(Continued)

(52) U.S. Cl.
CPC ..... *A24C 5/20* (2013.01); *A24C 5/1857* (2013.01); *A24F 40/70* (2020.01); *A24F 42/80* (2020.01);
(Continued)

(58) Field of Classification Search
None
See application file for complete search history.

(56) References Cited

U.S. PATENT DOCUMENTS 3,503,859 A * 3/1970 Herbert ..... B29C 59/10 204/165
4,113,197 A 9/1978 Harrington
(Continued)

FOREIGN PATENT DOCUMENTS

| | | | |
|---|---|---|---|
| CN | 100366198 | * | 2/2008 |
| DE | 102015001618 | | 8/2016 |
| EP | 0 439 827 | | 8/1991 |

OTHER PUBLICATIONS

International Search Report and Written Opinion for PCT/EP2018/063213 dated Jun. 7, 2018 (12 pages).

*Primary Examiner* — Timothy Kennedy
*Assistant Examiner* — Guy F Mongelli
(74) *Attorney, Agent, or Firm* — Mueting Raasch Group

(57) ABSTRACT

The present invention relates to a machine for the production of a component for an aerosol generating article, the machine including: —a buffer station, the buffer station including: # fixed sheet guides; # movable sheet guides which are movable in a reciprocating manner in a direction towards the fixed sheet guides and in a direction away from the sheet fixed guides; # an actuator for moving the movable sheet guides, wherein the fixed and movable sheet guides together define a zig-zag trajectory for the sheet having a variable length for varying the total length of the sheet of material in the buffer station; # supports for the sheet, the supports being arranged so that, when the movable sheet guides are moved towards the fixed sheet guides, at least one of the movable sheets guides is interposed between two different supports of the plurality; # an air system; # wherein the each of the supports defines an outer surface, at least one
(Continued)

of the outer surfaces having a first portion in which a sucking action is exerted by the air system to attract the sheet towards the outer surface and a second portion in which a blowing action is exerted by the air system to push the sheet away from the outer surface.

15 Claims, 9 Drawing Sheets

(51) Int. Cl.

| | |
|---|---|
| ***A24C 5/18*** | (2006.01) |
| ***B65H 20/10*** | (2006.01) |
| ***B65H 20/34*** | (2006.01) |
| ***B65H 5/06*** | (2006.01) |
| ***B65H 5/02*** | (2006.01) |
| ***A24F 40/70*** | (2020.01) |

(52) U.S. Cl.
CPC ..... *B65H 5/025* (2013.01); *B65H 5/062* (2013.01); *B65H 20/10* (2013.01); *B65H 20/34* (2013.01); *B65H 2301/342* (2013.01); *B65H 2301/5143* (2013.01); *B65H 2406/13* (2013.01); *B65H 2406/3124* (2013.01); *B65H 2406/323* (2013.01); *B65H 2408/2171* (2013.01); *B65H 2801/54* (2013.01)

(56) References Cited

U.S. PATENT DOCUMENTS

| | | | | |
|---|---|---|---|---|
| 5,827,166 | A | 10/1998 | Cestonaro | |
| 2005/0230449 | A1 | 10/2005 | Meyer | |
| 2015/0150302 | A1* | 6/2015 | Metrangolo ..... | A24C 5/01 131/77 |
| 2016/0295916 | A1 | 10/2016 | Malgat | |

* cited by examiner

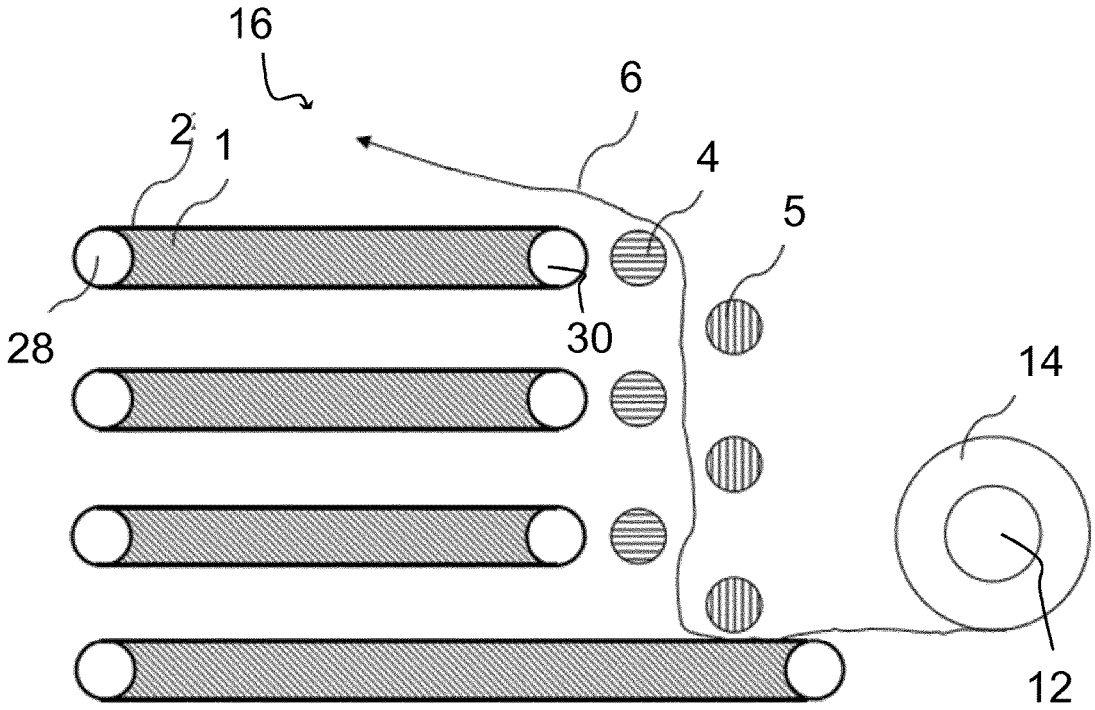
5 Fig. 8
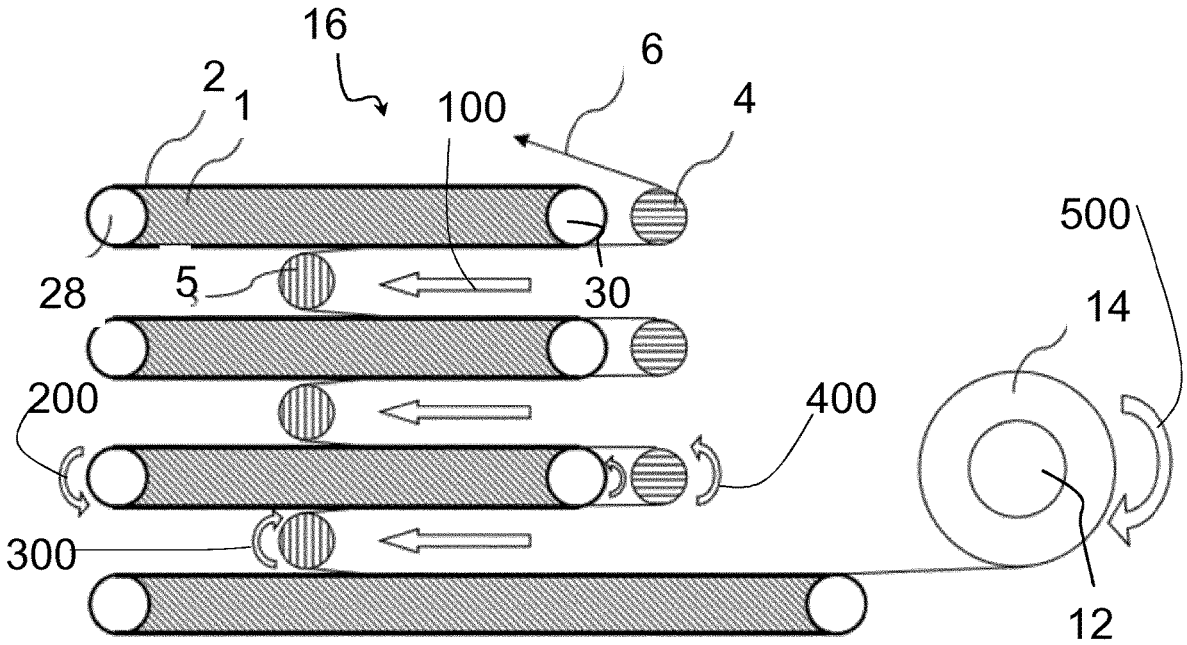
Fig. 9

MACHINE FOR THE PRODUCTION OF A COMPONENT FOR AN AEROSOL GENERATING ARTICLE

This application is a U.S. National Stage Application of International Application No. PCT/EP2018/063213 filed May 18, 2018, which was published in English on Nov. 22, 2018 as International Publication No. WO 2018/211116 A1. International Application No. PCT/EP2018/063213 claims priority to European Application No. 17171924.8 filed May 19, 2017.

The present invention is related to a machine for the production of a component for an aerosol generating article.

In some productions plant of aerosol generating articles, some materials in sheet format are running from one side (the so-called feeder side) of a production machine, where the sheet is packaged in "input unit" (for instance a bobbin), up to the other side of the production machine, where various treatments are applied to the sheet (such treatments include for instance crimping, compressing, etc.).

Such materials could be a homogenized tobacco material, also called TCL (Tobacco Cast Leaf), which is dried, and then cut in foils or sheets which are winded up into bobbins for storage and transport. This material, when coiled in bobbins, is difficult to unwind properly because the TCL is both sticky, so a rather high force needs to be applied in order to unwind it, and fragile, so that it can be easily torn apart. Other materials could be for instance PLA (Poly Lactic Acid) which is used to manufacture specific part of aerosol generating articles' filter. While the machines could run continuously, without interruption, the feeder side of the production machine needs to be periodically replenished as the sheet arrives in quantity limited by the sheet packaging format, for example bobbins, called input units.

In order to cope with the lack of sheet which occurs during the replacement of an input unit running empty by a new one without stopping or too much slowing down the processing of the sheet at the other end of the machine, a system may use moving rollers to create a buffer of sheet.

This "buffer system" may use several rollers which can move, and for this reason are called "movable rollers", toward or away from other rollers which are fixed ("fix rollers"), the sheet passing along these two kind of rollers.

During the replacement of the input unit, when the incoming sheet is stopped (or runs with a strongly reduced speed) to allow for instance splicing between the old sheet and the new one, the movable rollers are moved toward the fix rollers, in this way releasing the extra length of sheet that was running between them, and supplying the sheet to the treatment area of the machine while the new input unit is not yet running.

When the new input unit is running, then the movable rollers are moved back away from the fix rollers to create an extra long path for the sheet, in this way creating a buffer of sheet that can be used during the next replacement of input unit.

Usually such buffer system is vertical, meaning that the path followed by the sheet runs vertically.

In appended FIGS. 1 and 2, buffer systems according to this comparative example are shown. The rollers in the upper position are supposed to be the only ones that can be moved toward the rollers in lower position.

In FIG. 1 the input unit is running and the movable rollers are far apart, with a maximum distance between upper and lower rollers.

In FIG. 2 the input unit is being replaced. The movable rollers get closer to the fix rollers to deliver the sheet buffered in the previous distance they had between each other.

The quantity of sheet buffered in these buffer systems is roughly equal to twice the difference between the maximum and minimum distance from the movable rollers to the fix rollers, multiplied by the number of movable rollers.

A vertical buffer system implies that twice the weight of material passing between a lower roller and an upper roller (so a weight of a material having a length equal to the maximum height indicated in FIG. 1) is hold by the areas of material being in contact to the rollers in upper position.

Horizontal buffer systems are shown in appended FIG. 3.

In FIG. 3 a horizontal rollers buffer without supports is shown. In these horizontal buffers, the sheet is not resting on supports. In this case, there might be the disadvantage that the weight of the material is pulling the sheet perpendicular to the sheet path and could damage the sheet as well as make the sheet vibrates from one roller to the other, increasing possible damage.

In the production of aerosol generating articles, some sheets of material which are used may be quite fragile, may have a low tensile strength, while at the same time they may be heavy. For instance the TCL (Tobacco Cast Leaf) which is a sheet including a material containing tobacco, may have these properties and could be damaged because of having to carry its own weight if not supported. There is therefore a need of a machine for the production of a component for an aerosol generating article, said machine having a buffer system, which may preserve as much as possible the material, minimizing damages to the same. In a first aspect, the invention relates to a machine for the production of a component for an aerosol generating article, the machine including: a buffer station, the buffer station including: fixed sheet guides; movable sheet guides which are movable in a reciprocating manner in a direction towards the fixed sheet guides and in a direction away from the sheet fixed guides; an actuator for moving the movable sheet guides, wherein the fixed and movable sheet guides together define a zig-zag trajectory for the sheet having a variable length for varying the total length of the sheet of material in the buffer station; supports for the sheet, the supports being arranged so that, when the movable sheet guides are moved towards the fixed sheet guides, at least one of the movable sheets guides is interposed between two different supports; an air system connected to the supports; wherein each of the supports defines an outer surface, at least one of the outer surfaces having a first portion in which a sucking action by the air system is exerted to attract the sheet towards the outer surface and a second portion in which a blowing action by the air system is exerted to push the sheet away from the outer surface.

In the buffer of the invention, the presence of the support may help to bear some of the weight of the sheet of material, so that the sheet has to withstand a reduced stress. Further, thanks to the provision of an air system which can blow or suck air from a surface of the support, friction may be reduced in those parts where an "air cushion" is formed between the sheet and the surface of the support. On the other hand, the suction may be used as a "tool" to carry additional weight of the sheet of material, in particular more than the weight that the support can carry only by gravity.

As used herein, the term "sheet" denotes a laminar element having a width and length substantially greater than the thickness thereof. The width of a sheet is preferably greater than 10 millimeters, more preferably greater than 20 millimeters or 30 millimeters. Even more preferably, the width of the sheet is comprised between about 100 millimeters and 300 millimeters.

In a preferred embodiment, the sheet may be a sheet of a material containing alkaloids. More preferably, the sheet of material may be a sheet of homogenized tobacco material.

An "alkaloids containing material" is a material which contains one or more alkaloids. Among alkaloids, nicotine is a preferred one, which can be found in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may be then rolled in bobbins which are unwound in order to be further processed, to be part for example of an aerosol generating article, that is to be included in the aerosol-forming substrate of the aerosol generating article. In a "heat-not-burn" aerosol generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol generating article. This means that the aerosol composition that is generated by such a "heat-not-burn" aerosol generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The homogenized tobacco sheet generally includes, in addition to the tobacco, a binder and an aerosol-former. This composition leads to a sheet which is "sticky", that is, it glues to adjacent objects, and at the same time it is rather fragile having a relatively low tensile strength.

The present invention is especially adapted for sheet made of a material containing alkaloids, such as sheets of homogenized tobacco material as defined above, however it can be applied as well in any process wherein a sheet having such characteristics. The sheet may be wound into a bobbin. The bobbin shape can be any. It can have a substantially cylindrical shape; however an oval or anyhow deformed shape, such as a bobbin with bulges deforming a underlying cylindrical shape, do not hinder the application of the teaching of the invention.

The bobbin may for example be positioned on a hub for holding the bobbin. Preferably, the hub is rotatable around an axis and more preferably this axis of rotation coincides with the axis of rotation of the bobbin. The hub may include a motor for the rotation.

In order to have "storage" of sheet, for example when the bobbin needs to be changed from the hub, the machine of the invention includes a buffer station. The buffer station contains a surplus of sheet which is loosely wound around guides. The buffer station comprises fixed sheet guides and movable sheet guides. Preferably, it comprises at least two fixed sheet guides and at least two movable sheet guides. The movable guides can move towards and away from the fixed guides. The term "fixed" indicates that preferably the "fixed" guides do not change position, for example they do not move closer to the movable guides, however they can perform other movements, for example they can rotate around an axis.

The distance between the fixed guides and the movable guides can be varied between a certain minimal distance and a certain maximal distance. Preferably, the movable guides and fixed guides can be divided in pairs, each pair containing a movable and a fixed guide. The distance between the guides in the pairs is preferably the same. Being the sheet wound around the fixed guides and the movable guides, the fact that the distance between fixed and movable guides may change implies that also the amount of sheet in the buffer station may change.

The movement of the movable guides is preferably rectilinear. More preferably, it is a substantially horizontal movement.

The buffer station further comprises an actuator for moving the movable film guides. The actuator may be any, as long as it allows the described movement of the guides. Fixed guides and movable guides together define a zig-zag trajectory for the sheet having a variable length for varying the total length of sheet in the buffer station.

Fixed guides and movable guides are preferably rotatable around their axes. Their rotation pushes the sheet to travel through the buffer station. Each guide, in order to rotate, may include a motor. The guide may be idle.

The fixed and movable guides may be for example guide rollers. Preferably, the fixed and movable guides are arranged vertically one above the others. They may form a column. Other types of guides and guides' arrangements are possible. Preferably, during the movement of the movable guides, they remain aligned in a column.

The buffer station is configured to receive the sheet of material while it travels, for example at an essentially constant speed. By varying the distance between the fixed guides and the movable guides, the buffer is capable of transforming the essentially constant movement of the sheet into a stop-go movement and to pay out the sheet in the stop-go movement.

The buffer station is preferably constructed to guide the sheet in a substantially horizontal transport direction. That is, for the majority of time, the sheet preferably travels substantially horizontally. The buffer station is constructed to guide the sheet in a substantially vertical orientation, forming layers of sheet stacked one above the other.

Further, the buffer station includes supports for the sheets. Preferably, for each portion of sheet connecting a fixed guide and a movable guide, a support is present. The supports are further arranged so that, when the movable sheet guides are far away from the fixed sheet guides, at least one of the movable sheets guide is interposed between two different supports. Preferably, the two supports between which the movable guide is interposed are two adjacent supports. Preferably, a movable guide is interposed between each couple of adjacent supports. Preferably, when the movable guides are close to the fixed guide so that their mutual distance is at a minimum, the movable guides are not interposed between the supports. In this configuration, preferably the fixed and movable guides form two parallel columns outside the supports, preferably on one side of the supports.

Preferably, the supports are vertically stacked one above the other. Preferably, there are at least two supports.

In this way, preferably, in the buffer there is substantially a layered structure of a first support, a first layer of sheet and a second layer of sheet, a second support, a third layer of sheet and a fourth layer of sheet, a third support and so on N times depending on the number N of supports. Between two supports, preferably two layers of sheet are present.

Further, the machine includes an air system which is connected to the supports. The air system may be located anywhere in the machine, as long as there is a fluid connection between the air system and the supports. Air may be sucked from the support by the air system or air may be blown from the support by the air system.

Each of the supports defines an outer surface. In a support, the outer surface can be divided in two portions, first and second portion. In the first portion, the action of sucking is exerted. In the second portion, the blowing action is exerted. The first portion thus attracts the sheet towards the outer surface of the support and the second portion pulls the sheet away from the outer surface.

The air suction or blowing may take place due to apertures formed in the outer surface.

In this way, the sheet does not slide over the support and it is preserved from damage.

Further, the sheet is supported by the sucking action and the weight bearing is shared between the sheet itself and the support. Friction is also reduced in the second portion because an "air cushion" is formed between the outer surface and the sheet.

The machine of the invention therefore is suitable to buffer also relatively fragile or sticky sheets of material.

Preferably, the machine includes a hub for holding a bobbin of the sheet of material. Preferably the sheet of material is available in bobbins which are unwound for example while rotating in the hub.

Preferably, the outer surface is a movable surface. More preferably, a speed of the outer surface is selected depending on a rotational speed of the fixed or movable sheet guides. The movable surface allows an easy transport of the sheet because the movement of the sheet through the buffer station is not due to the movement of the movable and fixed guides alone. The risk of breakage of the sheet is reduced because the pulling force on the sheet is reduced.

Advantageously, the linear speed of the movable surface may be synchronized with the angular speed of the fixed and movable guides.

Preferably, the supports include moving belts, each moving belt comprising the outer surface. Advantageously, the moving belts are wound around two rollers which are located in fixed positions with respect to the fixed guides. Some of the rollers can also define the fixed guides themselves. The surface of the belt may thus form the outer surface of the support.

Preferably, the outer surface includes an upper surface towards which the sheet is laid by gravity and a lower surface from which the sheet is detached by gravity, and wherein the first portion belongs to the lower surface and the second portion belongs to the upper surface. Preferably, the sucking is exerted towards the portion or layer of sheet which "hangs" due to gravity. Between two adjacent supports, there are two substantially parallel layers of sheet. The first layer is adjacent to the upper surface of the first support and the second layer is adjacent to the lower surface of the second support. Therefore, in order to avoid breakage of the sheet due to its own weight, the second layer of sheet which is not supported by the support without air sucking intervention, is supported by the sucking action. Air is thus suck through the lower surface of the second support in order to draw the layer of sheet closer to the outer surface and transport it by the movement of the surface itself. Stress on the sheet may be reduced.

Further, the first layer of sheet moves above the upper surface of the first support. Due to gravity, the first layer of sheet is in contact to the upper surface. In order to lower the friction, an "air cushion" is formed by air which is blown from the upper surface.

Preferably, at least one of the supports includes a temperature regulating device adapted to heat or cool the outer surface or the sheet of material. This is particularly advantageous in horizontal buffer stations, so that a substantially homogeneous temperature can be obtained. Indeed, vertical supports temperature control may be affected by convection, thereby likely leading to temperature discrepancies along such vertical supports. Advantageously, due to the fact that the buffer station includes an air system, the temperature regulating device may be integrated with the air system. The air system therefore may blow cool or hot air in order to cool or heat the sheet. In this way, the sheet exits from the buffer station already heated or cooled, that is, the sheet has been already subjected to a thermal treatment in the buffer station.

Preferably, the outer surface is realized in a low friction material. This may reduce the friction between the sheet of material and the outer surface.

Preferably, the outer surface of the support is textured so as to have an anti-adhesion property and to minimize the friction of the sheet with outer surface to prevent wearing of outer surface and sheet. Further, friction may create undesired temperature increase. The material used for the outer surface is preferably stainless steel. Preferably, the outer surface material is also very smooth to prevent friction.

More preferably, the upper and lower surfaces define parallel planes. More preferably, the upper and lower surfaces define horizontal planes. The supports are thus preferably horizontal so as to form a horizontal buffer station. Advantageously, in the case in which the support includes a moving belt, the feature that the upper and lower surface define parallel planes is obtained with two rollers of the moving belt which have substantially the same diameter.

Preferably, the outer surface includes a plurality of holes, from which air can be blown or sucked. From the holes, the sucking action and the blowing action on the first and second portion of the outer surface can be exerted in an effective manner.

Preferably, the fixed sheet guides or the movable sheet guides include guide rollers. Guide rollers are preferably rotatable around an axis.

Preferably, the fixed sheet guides are positioned one above the other in a vertical arrangement. This may allow the realization of a compact buffer station, which occupies a limited volume.

Preferably, the machine according to the invention includes one or more temperature sensors adapted to measure a temperature of the sheet. More preferably, the air system according to the invention includes a temperature controlled air generator adapted to blow air at a selected given temperature. Advantageously, the temperature controlled air generator allows heating or cooling the outer surface or the sheet of material. The same element, that is, the air generator, has a double function.

In a second aspect, the invention relates to a machine for the production of a component for a smoking article, in particular an aerosol generating article, the machine including: a hub for holding a bobbin of a sheet of material; a buffer station, the buffer station including: fixed sheet guides; movable sheet guides which are movable in a reciprocating manner in a direction towards the fixed sheet guides and in a direction away from the sheet fixed guides; an actuator for moving the movable sheet guides, wherein the fixed and movable sheet guides together define a zig-zag trajectory for the sheet having a variable length for varying the total length of the sheet of material in the buffer station; a temperature regulating device adapted to heat or cool the sheet of material.

Advantageously, thanks to the temperature regulating device, the sheet exits from the buffer station already heated or cooled. The sheet has been already preferably subjected to a thermal treatment in the buffer station.

Further advantages of the invention will become apparent from the detailed description thereof with no-limiting reference to the appended drawings:

FIG. 8 is a schematic lateral view of the machine of FIG. 7, in a first operative condition;

FIG. 9 is a schematic lateral view of the machine of FIG. 7, in a second operative condition;

With reference to the FIGS. 4-16, a machine for the production of a component for an aerosol generating article, according to the present invention is represented and indicated with reference number 10.

Figure 1:
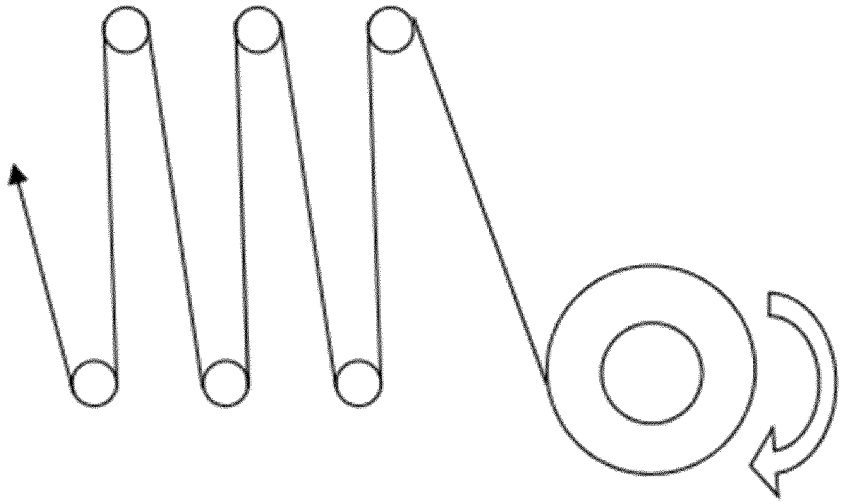
FIG. 1 is a schematic lateral view of a machine for the production of a component for an aerosol generating article according to a comparative example, in a first operative condition.
Figure 2:
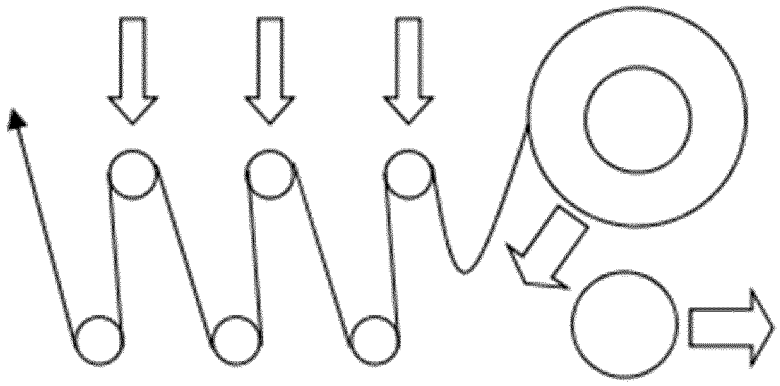
FIG. 2 is a schematic lateral view of the machine of FIG. 1, in a second operative condition.
Figure 3:
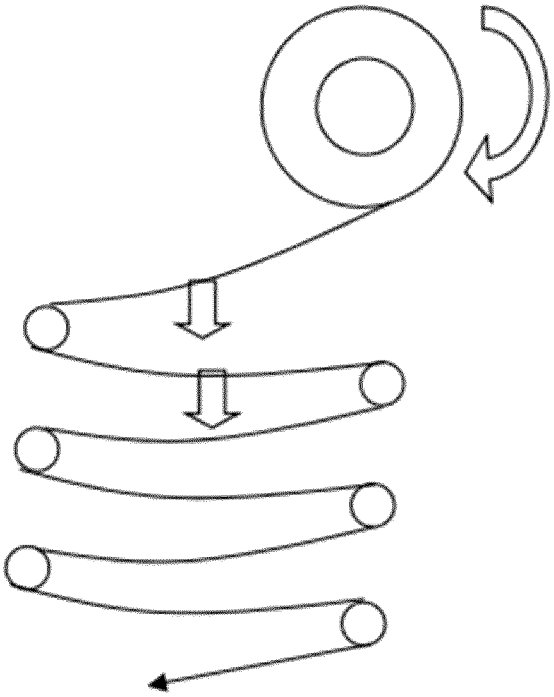
FIG. 3 is a schematic lateral view of another machine for the production of a component for an aerosol generating article according to another comparative example.
Figure 4:
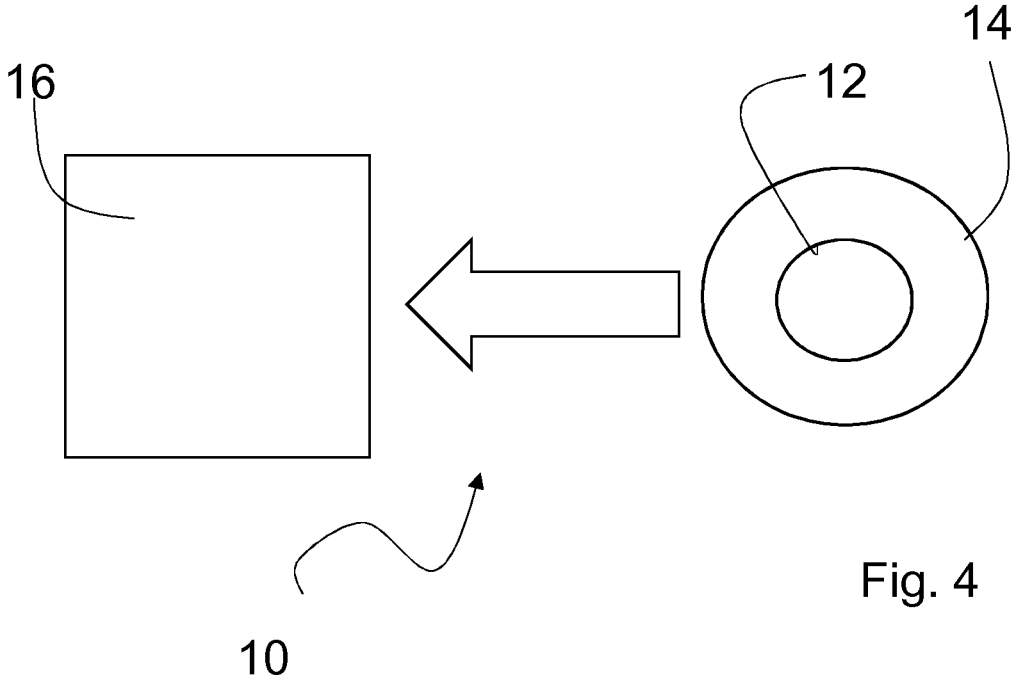
FIG. 4 is a schematic lateral view of a machine for the production of a component for an aerosol generating article according to the present invention.

FIGS. 1-3 show vertical and horizontal buffers according to the comparative examples, and have been already described above. As visualized in FIG. 4, the machine 10 (or manufacturing machine) includes a hub 12 for holding a bobbin 14 of a sheet 6 of material and a buffer station 16.

The bobbin 14 shown in the figures has a round, for example cylindrical, shape. However, the invention works fine with bobbins even when the bobbins do not have round shape. Sheet 6 is a sheet of a homogenized tobacco material (sheet 6 is better visible in FIGS. 8, 9).

The buffer station 16 includes a plurality of fixed sheet guides 4, a plurality of movable sheet guides 5 and a plurality of supports 1 for the sheet 6. The supports 1 are substantially horizontal, so that the buffer station 16 is a "horizontal rollers buffer with supports", that is, the supports are horizontal and the sheet in the buffers form substantially horizontal layers, one above the other. Substantially horizontal supports 1 provide the advantage of supplying a weight of the layers.

The movable sheet guides 5 are movable in a reciprocating manner in a direction towards the fixed sheet guides 4 and in a direction away from the sheet fixed guides 4.

An actuator 18 (visible in FIG. 10) for moving the movable sheet guides 5 is provided, wherein the fixed and movable sheet guides 4, 5 together define a zig-zag trajectory for the sheet 6 having a variable length for varying the total length of the sheet 6 of material in the buffer station 16 (see FIGS. 8 and 9).

The supports 1 are arranged so that, when the movable sheet guides 5 are moved towards the fixed sheet guides 4, the movable sheets guides 5 are interposed between two different supports 1, in particular between two consecutive supports 1 (see FIG. 9).

In the preferred embodiment shown in the figures (see in particular FIGS. 8 and 9), the fixed sheet guides 4 and the movable sheet guides 5 are guide rollers. The fixed sheet guides 4 are positioned one above the other in a substantially vertical arrangement.

In the preferred embodiment shown in the figures (see in particular FIGS. 5 and 6), each support 1 includes a moving belt 2, which is also indicated as conveyor belt. The moving belt 2 defines an outer surface 20, which is a movable surface. The outer surface 20 is realized in a low friction material. Each horizontal support 1 has a single moving belt 2 running around it, and further includes a first roller 28 and a second roller 30 connected to the moving belt 2 and being located at each end portion of the horizontal support 1 in order to move the belt.

The sheet 6 is carried or dragged by the moving belt 2, which reduces the possible friction between the sheet 6 and the horizontal support 1.

Figure 13:
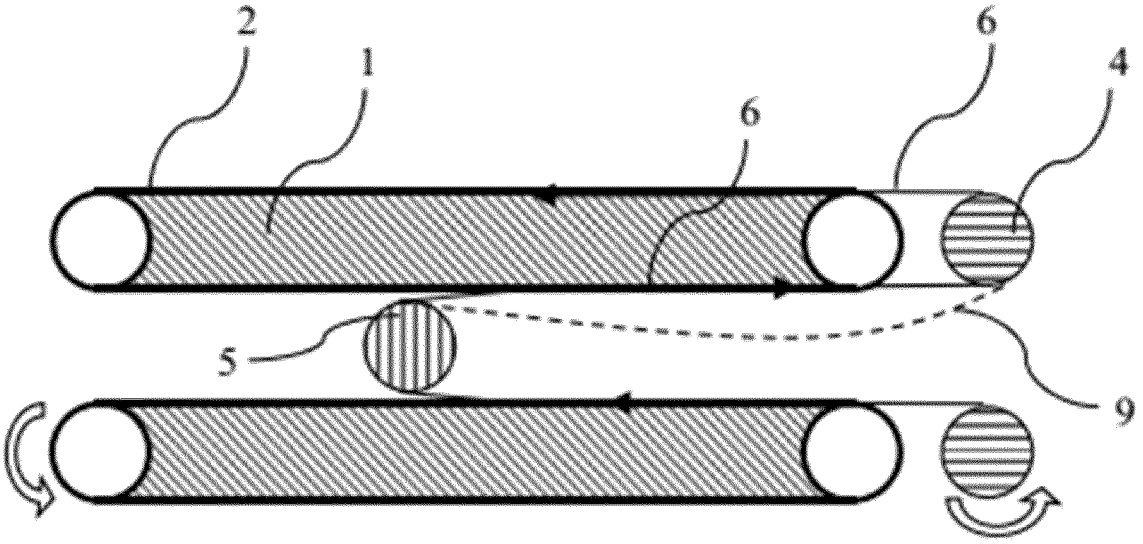
FIG. 13 is a schematic lateral view of the machine of FIG. 7, in a third operative condition.

The outer surface 20 includes an upper surface 22 towards which the sheet 6 is laid by gravity and a lower surface 24 from which the sheet 6 is detached by gravity (see in particular FIG. 13).

The upper and lower surfaces 22, 24 define parallel planes.

Furthermore, the upper and lower surfaces 22, 24 define substantially horizontal planes.

The outer surface 20 has a first portion in which a sucking action is exerted to attract the sheet 6 towards the outer surface 20 and a second portion in which a blowing action is exerted to push the sheet 6 away from the outer surface 20. The first portion belongs to the lower surface 24 and the second portion belongs to the upper surface 22.

The outer surface 20 includes a plurality of holes 26 (visible in FIGS. 14-16), from which air can be blown or sucked. Air system, such as blowing/air drawing mechanism (not depicted in the figures), allows limiting frictions between the sheet 6 and the supports 1, as well as sustaining the sheet 6 while not limiting the movement of the movable sheet guides 5. The blown air allows pushing the sheet 6 away from the outer surface 20 by few millimeters or tenths of millimeter, so as to create air support between the moving belt 2 and the sheet 6 to reduce friction.

Figure 14:
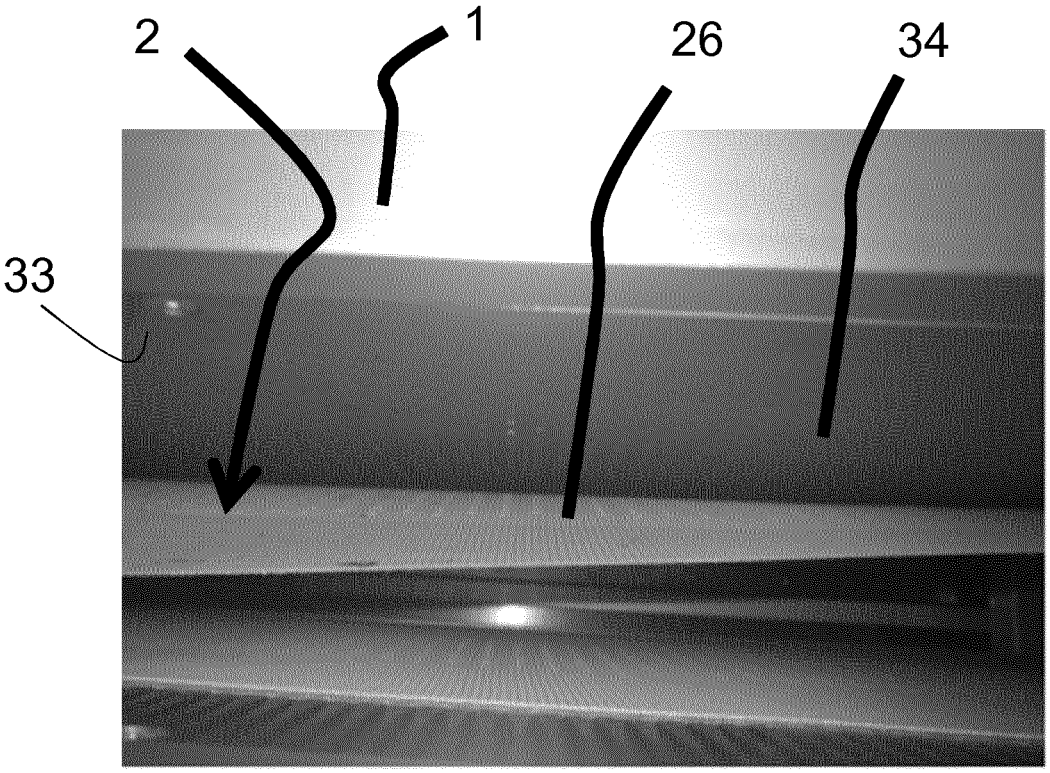
FIG. 14 is a schematic perspective view of a detail of the machine of FIG. 7.

The horizontal supports 1 also defines surfaces 33 (FIGS. 14-16) around which the belt 2 is positioned, those surfaces have tiny holes 34, acting as air outlet/inlet, allowing the air blown by the air mechanism to go out, or, depending of the case, the air drawn by the air mechanism to be taken from the outside, creating suction effect (see FIG. 14). Therefore the air blown or sucked by the air system or air generator passes through holes 34 and 26 in order to enter or to get out from the supports. The air generator preferably is fluidly connected with the interior of all supports. Preferably surfaces 33 surrounds substantially an hollow space where the air can be conveyed.

According to preferred embodiments, only the bottom surface or both top and bottom surfaces of the horizontal supports 1 have such holes 34.

According to preferred embodiments, the air mechanism, for each horizontal support 1, can independently blow or draw air through the top surface of the horizontal support 1 while it can independently blow or draw air through the bottom surface.

In a preferred embodiment, the air mechanism draws air through the bottom surface.

The air drawn through the bottom surface of the horizontal support 1 and the holes 26 of the moving belt 2, creates a suction effect on the sheet 6 and makes it stuck to the moving belt 2, helping the sheet 6 to carry its own weight without possible damage.

Furthermore, an additional benefit of the invention is that the air mechanism can also act as a temperature control system for the system as well as for the material being processed, helping preparing the sheet 6 for the treatment applied to it by the manufacturing machine 10, as detailed below.

Preferably, at least one of the supports 1 includes a temperature regulating device (not visible in the appended drawings) adapted to heat or cool the outer surface 20 or the sheet 6 of material. In particular, the machine 10 can include a temperature controlled air generator adapted to blow air at a selected given temperature.

Such temperature controlled air generator could for instance uses resistors to heat the air and thermoelectric elements to cool the air.

Further, the temperature controlled air generator included in the air mechanism gives the possibility to adjust the temperature of the air blown into the horizontal supports 1, so as to cool or heat the horizontal supports 1 (for instance to cool down the supports 1 in case there are frictions with the moving belt 2) as well as to cool or heat the sheet 6.

This is another benefit of the invention as such temperature control allows to influence or control the temperature of the sheet 6 which can be used to prepare the sheet 6 material for the upcoming treatment part of the machine 10.

The machine 10 includes one or more temperature sensors (not visible in the drawings) adapted to measure a temperature of the sheet 6. Preferably, the air system and the temperature regulating device are connected to the temperature sensors for a feedback mechanism.

The temperature sensors could sense the temperature of the sheet 6 and so to automatically adjust the temperature of the blown air so that the temperature of the sheet 6 stay in a predetermined range.

In alternative, the horizontal supports 1 can be compartmented so as to present two horizontal containers, upper and lower, to independently push/suck the upper surface 22 of the belt 2 and the lower surface 24 of the belt 2.

Figure 5:
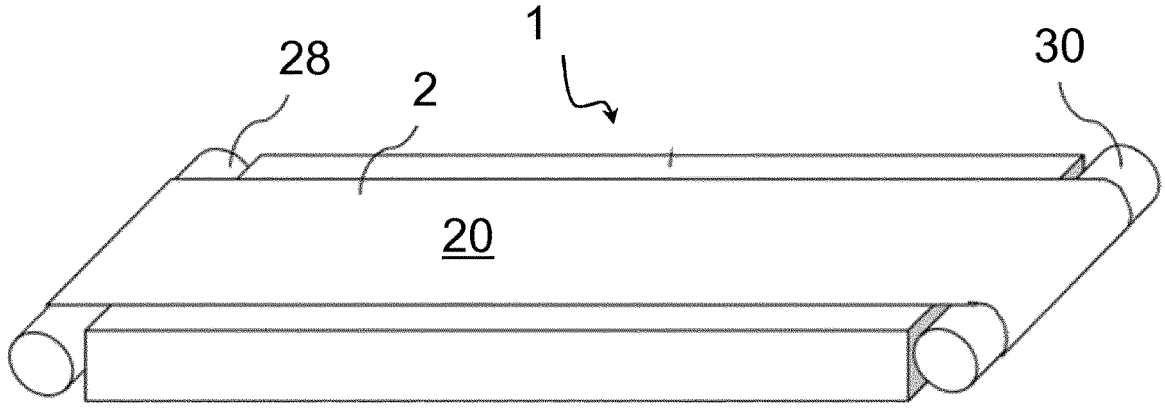
FIG. 5 is a schematic perspective view of a component (support of the sheet) of the machine for the production of a component for an aerosol generating article of FIG. 4.
Figure 6:
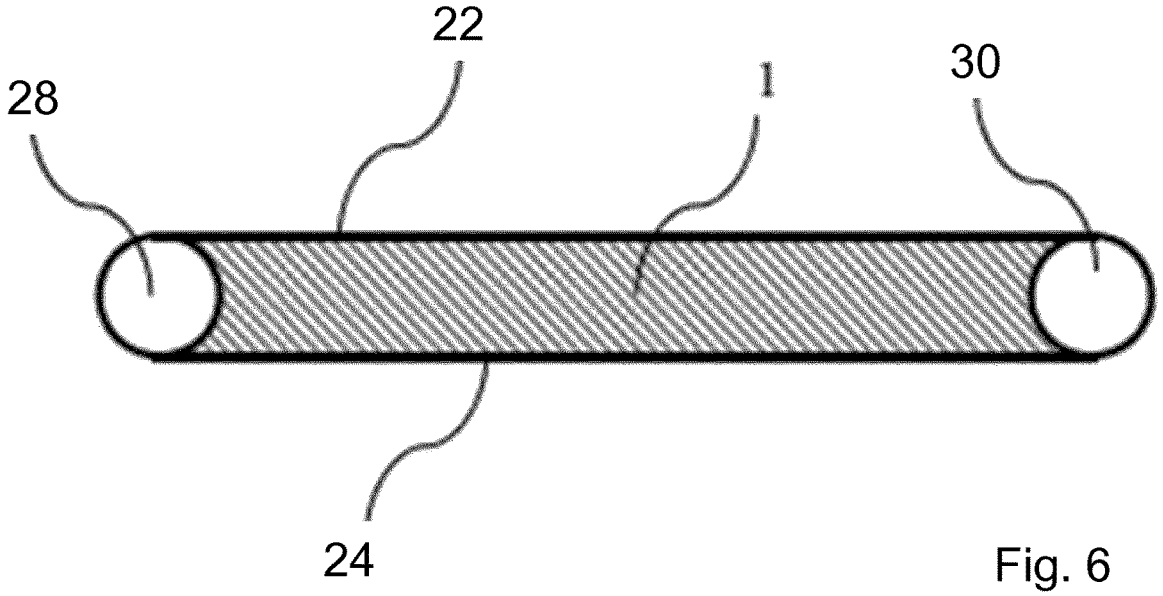
FIG. 6 is a schematic lateral view of the component of FIG. 5.
Figure 7:
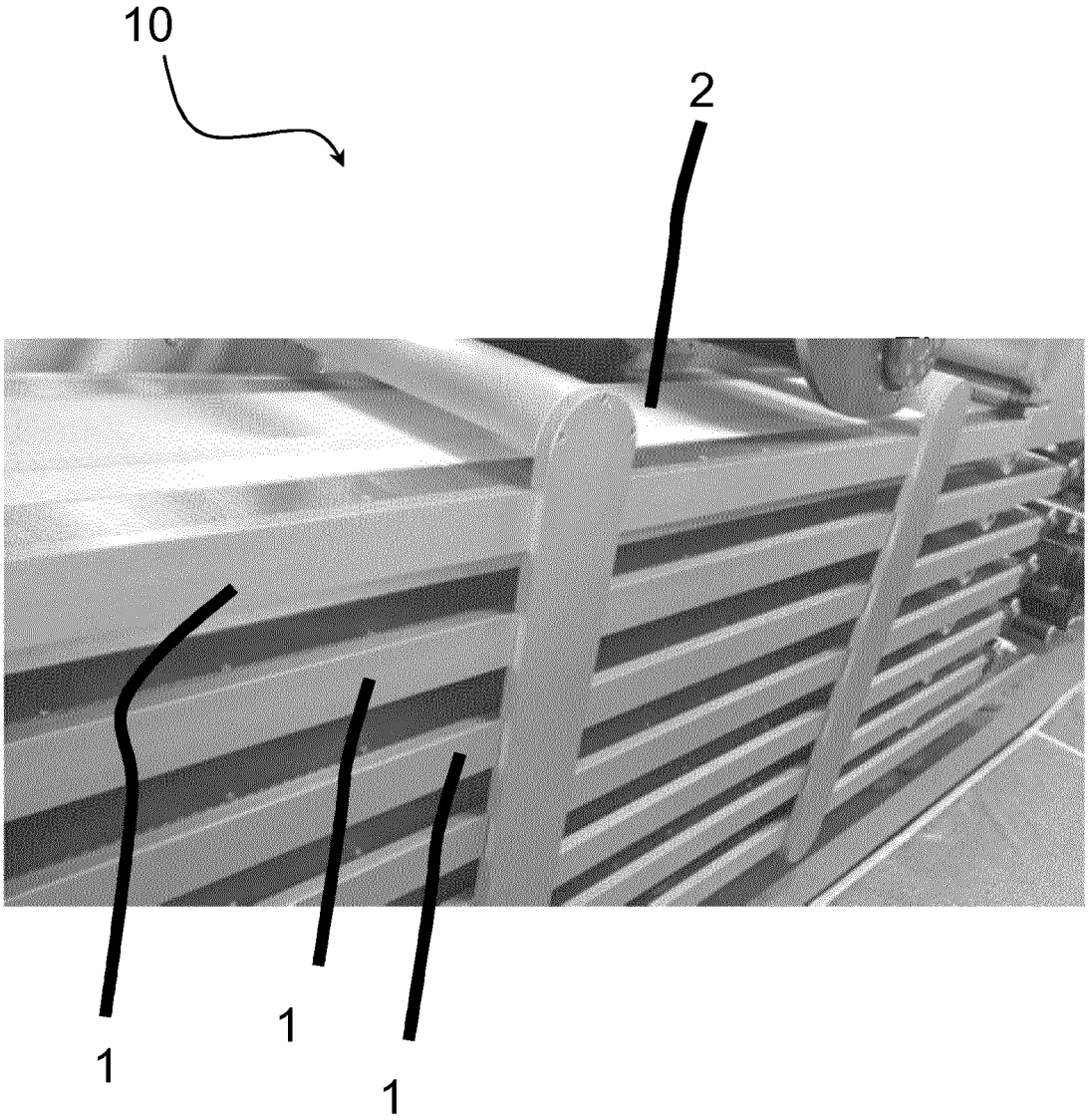
FIG. 7 is a schematic perspective view of the machine for the production of a component for an aerosol generating article of FIGS. 4-6.

In FIGS. 5 and 6 a horizontal support 1 is shown, with its moving belt 2 going all around, and the first roller 28 and the second roller 30 of the moving belt 2.

According to a preferred embodiment, one or both of the rollers 28, 30 of the moving belt 2 are motorized to make the belt 2 move.

The machine 10 includes a specific architecture of the horizontal supports 1 and of the guide rollers 4, 5.

The machine 10 includes several horizontal supports 1, in a vertical stacking set-up, one above the other, as well as respective rollers 28 and 30, along which the sheet 6 runs.

According to preferred embodiments, the sheet 6 can move from the lowermost portion to the upmost portion (i.e. from the lowest horizontal support 1 to the highest) or from the upmost to the lowermost.

A specific horizontal support 1 can be slightly longer than the other so as to catch the incoming sheet 6. In FIGS. 8 and 9, the sheet 6 moves from the lowermost to the upmost position, and so the slightly longer horizontal support 1 is the lowest one.

Aligned with each horizontal support 1, there is a "fixed guide roller" 4 (fixed sheet guide), that is, a guide roller which does not move horizontally or vertically and only rotates on its axis.

The rotation of the fixed guide roller 4 can be a free rotation generated by the sheet 6 passing or an active motorized rotation dragging the sheet 6.

These fixed guide rollers 4 are aligned in a vertical column.

Horizontally between each couple of horizontal supports 1, there is a "movable guide roller" 5 (movable sheet guide).

These movable guide rollers 5 can move horizontally along rails 32 and are motorized rollers 5, meaning that their rotation is motorized and drags the sheet 6.

The movement of the movable guide rollers 5 away from the fixed rollers 4 creates the buffering of the sheet 6 as illustrated in FIGS. 8-12.

These movable guide rollers 5 are aligned in a vertical column.

The distance between two consecutive horizontal supports 1 is roughly a bit superior to the diameter of the movable guide rollers 5.

The number of horizontal supports 1 as well as the distance which the movable rollers 5 can travel determine the size of the buffer of sheet 6.

FIGS. 8 and 9 illustrate the horizontal supports 1, their moving belts 2, the rollers 28 and 30 of the moving belts 2, the fixed rollers 4, the movable rollers 5, the sheet 6, and an input unit of sheet 6 which in this embodiment is bobbin 14.

In FIG. 8 the machine 10 is not yet working, and the sheet 6 is just put in its correct path in between the two columns of the fixed and movable guides.

In FIG. 9 the machine 10 is working and the movable guide rollers 5 have been moved away from the fixed guide rollers 4, pulling the sheet in their movement. The sheet 6 thus forms a plurality of layers travelling from one guide to the next one. Between the layers, the supports 1 are positioned.

The arrows in the figures indicate the direction of motion of the sheet 6 (arrow 100), of the horizontal translation of the movable guide rollers 5 (same arrow 100, the movement being in the same direction, rotation of the roller 5 is arrow 200) as well as the rotations of the fixed guide rollers 4 (arrow 400), of the input unit 7 (arrow 500) and the rollers 28, 30 (arrow 200) of the moving belts 2 of the horizontal supports 1.

Figure 10:
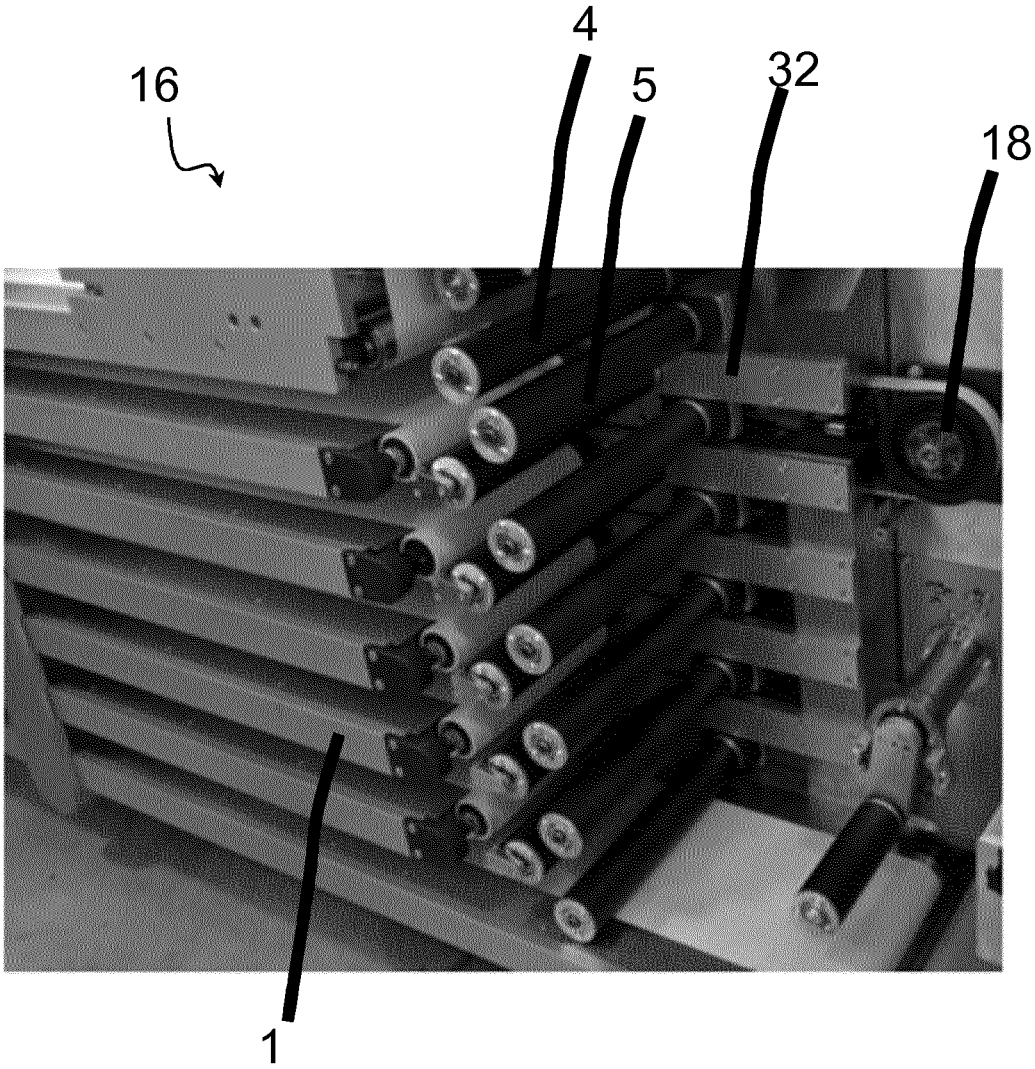
FIG. 10 is a schematic perspective view of the machine of FIG. 7, in the first operative condition.
Figure 11:
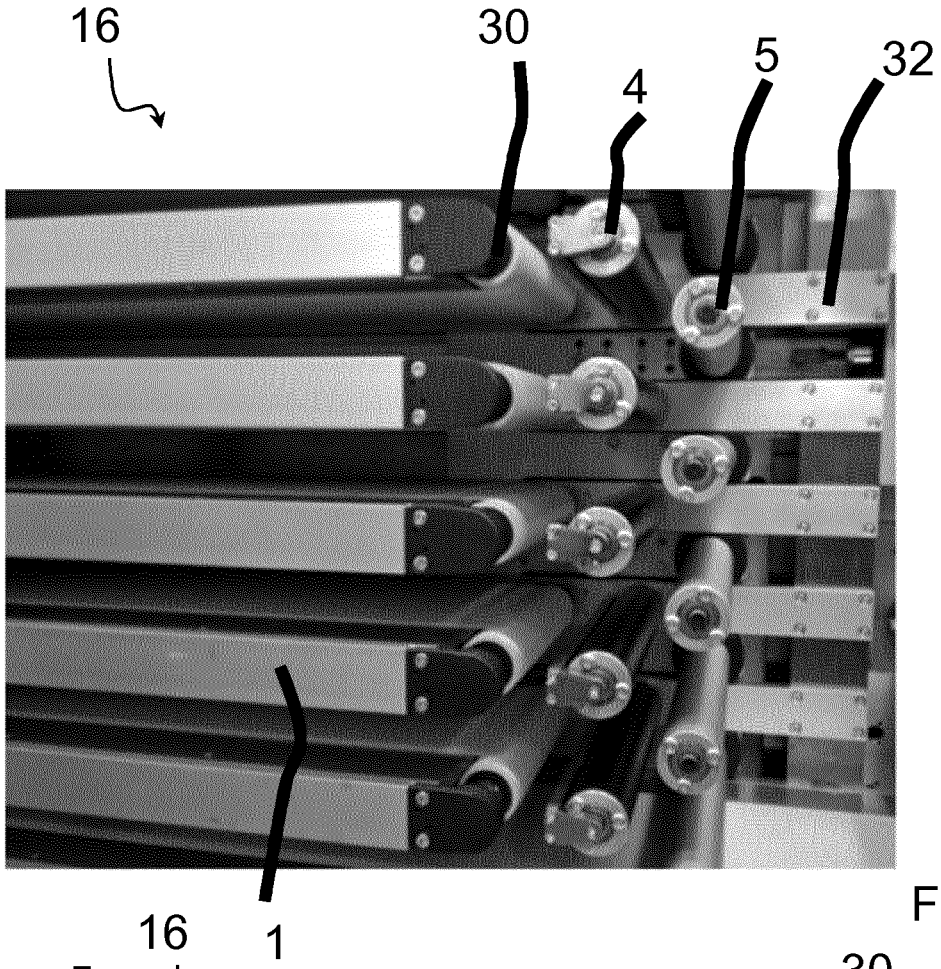
FIG. 11 is a further schematic perspective view of the machine of FIG. 7, in the first operative condition, taken from another point of view.

In FIGS. 10 and 11 the machine 10 has not started production yet.

Figure 12:
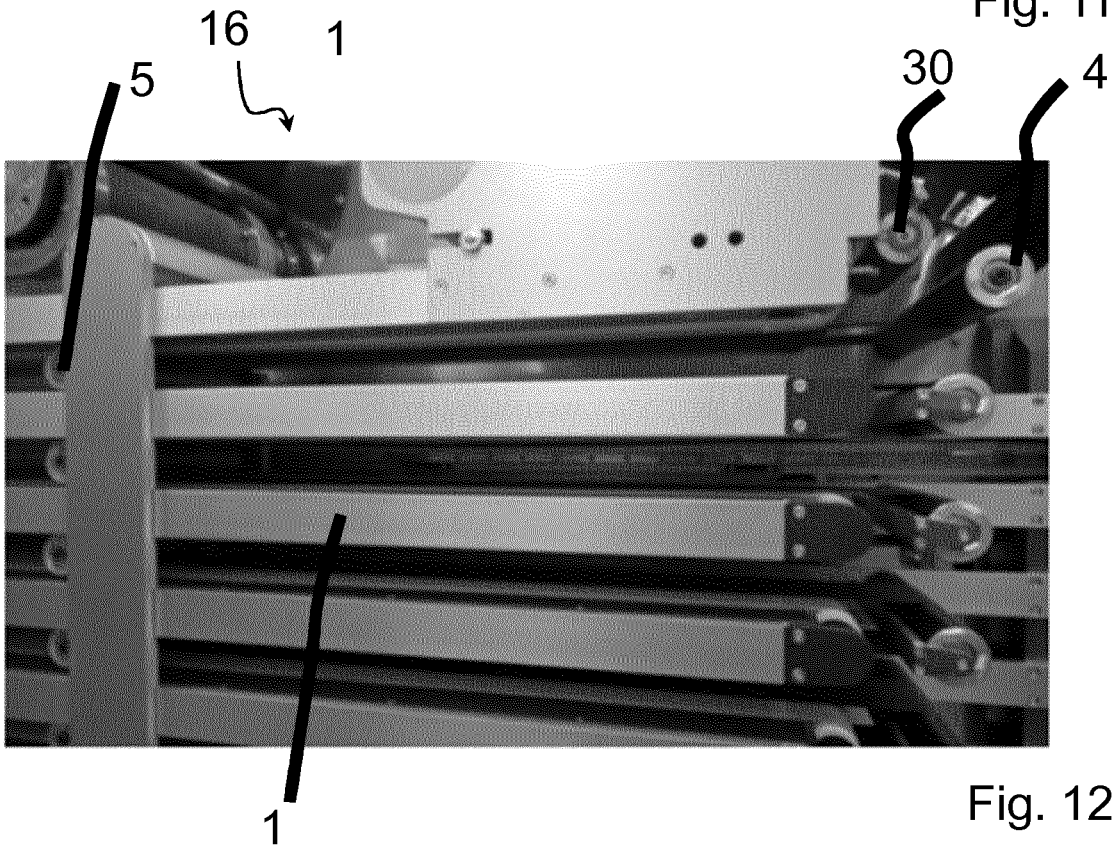
FIG. 12 is a schematic perspective view of the machine of FIG. 7, in the second operative condition.

In FIG. 12 the machine 10 has started production, with the movable guide rollers 5 which have been moved away from the fixed guide rollers 4.

In FIGS. 7 and 10-12, there are seven horizontal supports 1 one above the other, with the slightly longer one at the bottom.

The dotted line 9 in FIG. 13 shows what could be the path of the sheet 6 without the sucking air action or the blowing air action of the air mechanism. With the drawing air of the air mechanism, the sheet 6 is stuck to the moving belt 2 and to the bottom surface of the horizontal support 1.

It is important to note that the direction of the moving belt 2 goes away from the fixed guide roller 4 when the belt 2 runs on the top surface and toward the fixed guide roller 4 when the belt 2 runs on the bottom surface, and that this direction is the same than the direction of the sheet 6.

So when the sheet 6 is stuck to the moving belt 2 running under the bottom surface of the horizontal support 1, as well as when the sheet 6 is on the top surface of the horizontal support 1, the sheet 6 is dragged in the correct direction by the moving belt 2. The air drawn by the air mechanism through the bottom surface of the horizontal support 1 acts as an "active support" for the sheet 6. This active support takes place when the sheet 6 moves from the movable roller 5 to the fixed roller 4, that is when the sheet 6 goes under and next to the bottom surface of the horizontal support 1.

This "active support" has no materiality and thus it cannot block the movable rollers 5 in their movements, allowing them to create the buffer of the sheet 6. The air blown by the air mechanism through the top surface of the horizontal support 1 can be used to decrease the friction of the moving belt 2 running on the top surface of the horizontal support 1, and so it can be used to reduce the generated friction, which increases the temperature in the moving belt 2 area that can be transmitted to the sheet 6 and could alter its properties.

FIG. 14 shows details of the air inlet/outlet of the horizontal support 1, as well as the moving belt 2 and the holes 26 of the moving belt 2. FIG. 14 shows the bottom surface of a horizontal support 1 and the top surface of another horizontal support 1.

Figure 15:
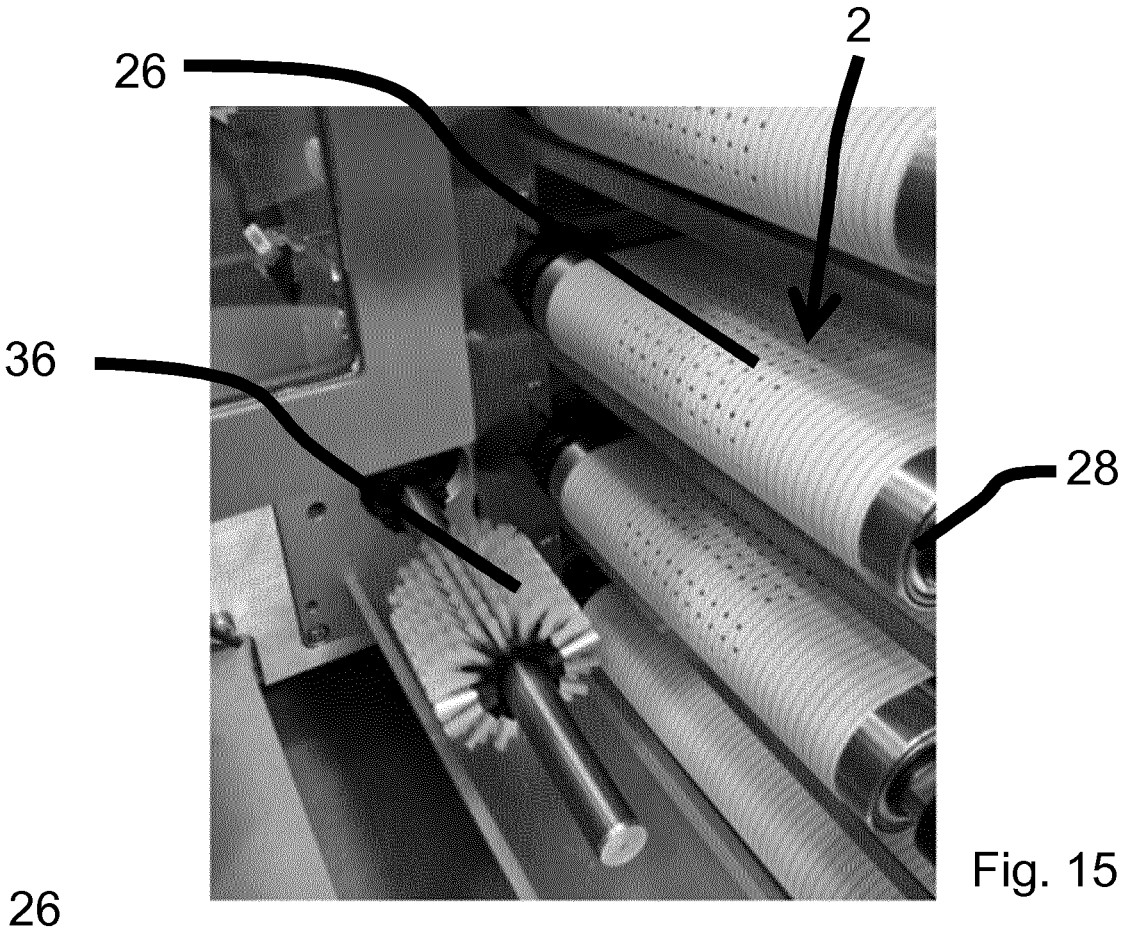
FIG. 15 is a schematic perspective view of another detail of the machine of FIG. 7.

FIG. 15 shows details of the holes 26 of the moving belt 2.

According to a preferred embodiment shown in FIG. 15, the machine 10 comprises a group 36 of rotating brushes which are at the end of the horizontal supports 1 to continuously clean the moving belts 2 and holes 26 of the moving belts 2 to assure they are working properly, as well as removing potential fragment of material coming from the sheet 6 so as to avoid contamination of the sheet 6.

Figure 16:
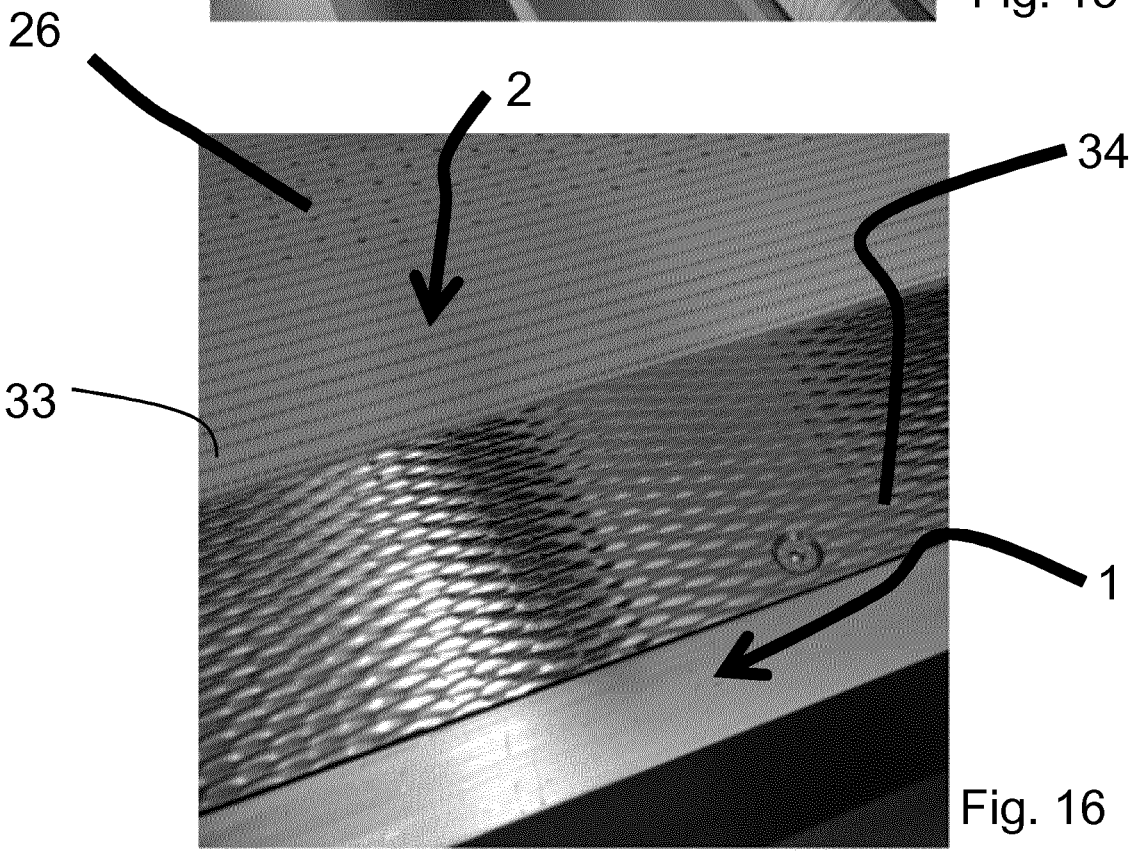
FIG. 16 is a schematic perspective view of a further detail of the machine of FIG. 7.

FIG. 16 shows details of the holes 26 of the moving belt 2 and surface 33 of the horizontal support 1.

According to a preferred embodiment shown in FIG. 16, the top and bottom surfaces 33 of the horizontal support 1 are textured so as to have an anti-adhesion property and to minimize the frictions with the moving belt 2 to prevent wearing of the moving belt 2 as well as frictions which increase the generated temperature. The material used for the top and bottom surfaces of the horizontal support 1 is also very smooth to prevent friction. Preferably, this material is stainless steel.

The invention claimed is:

1. A machine for the production of a component for an aerosol generating article, the machine including:

a buffer station for a sheet of material, the buffer station including:

fixed sheet guides;

movable sheet guides which are movable in a reciprocating manner in a direction towards the fixed sheet guides and in a direction away from the sheet fixed guides;

an actuator for moving the movable sheet guides, wherein the fixed and movable sheet guides together define a zig-zag trajectory for the sheet having a variable length for varying the total length of the sheet of material in the buffer station;

supports for the sheet, the supports being arranged so that, when the movable sheet guides are moved towards the fixed sheet guides, at least one of the movable sheets guides is interposed between two different supports;

an air system connected to the supports;

wherein each of the supports defines an outer surface, at least one of the outer surfaces having a first portion in which a sucking action is exerted by the air system to attract the sheet towards the outer surface and a second portion in which a blowing action is exerted by the air system to push the sheet away from the outer surface.

2. The machine according to claim 1, wherein the outer surface is a movable surface.

3. The machine according to claim 2, wherein a speed of the outer surface is selected depending on a rotational speed of the fixed or of the movable sheet guides.

4. The machine according to claim 1, including a hub for holding a bobbin of the sheet of material.

5. The machine according to claim 1, wherein the supports include moving belts, each moving belt including the outer surface.

6. The machine according to claim 1, wherein the outer surface includes an upper surface towards which the sheet of material is laid by gravity and a lower surface from which the sheet is detached by gravity, and wherein the first portion belongs to the lower surface and the second portion belongs to the upper surface.

7. The machine according to claim 1, wherein at least one of the supports includes a temperature regulating device adapted to heat or cool the outer surface or the sheet of material.

8. The machine according to claim 1, wherein the outer surface is realized in a low friction material made of stainless steel.

9. The machine according to claim 6, wherein the upper and lower surfaces define parallel planes.

10. The machine according to claim 9, wherein the upper and lower surfaces define horizontal planes.

11. The machine according to claim 1, wherein the outer surface includes a plurality of holes, from which air can be blown or sucked.

12. The machine according to claim 1, wherein the fixed sheet guides or the movable sheet guides include rollers.

13. The machine according to claim 1, wherein the fixed sheet guides are positioned one above the other in a vertical arrangement.

14. The machine according to claim 1, including one or more temperature sensors adapted to measure a temperature of the sheet of material.

15. The machine according to claim 1, wherein the air system includes a temperature controlled air generator adapted to blow air at a selected given temperature.

* * * * *